US005798607A

United States Patent [19]

Donofrio

[11] Patent Number: 5,798,607

[45] Date of Patent: Aug. 25, 1998

[54] PHOSPHOR SEARCH INCLUDING A NON-PIGMENTED PHOSPHOR AND RGB PHOSPHOR ELEMENTS FOR A CRT

[75] Inventor: Robert L. Donofrio, Ann Arbor, Mich.

[73] Assignee: U.S. Philips Corporation, New York, N.Y.

[21] Appl. No.: 832,896

[22] Filed: Apr. 3, 1997

[51] Int. Cl.[6] ..... H01J 29/32

[52] U.S. Cl. ..... 313/461; 313/466; 313/467; 313/470; 313/473; 313/474

[58] Field of Search ..... 313/461, 466, 313/467, 470, 473, 474

[56] References Cited

U.S. PATENT DOCUMENTS

| | | | |
|---|---|---|---|
| 3,160,774 | 12/1964 | Guy | 313/470 |
| 3,651,362 | 3/1972 | Takita | 313/92 |
| 3,884,694 | 5/1975 | Gallaro et al. | 313/474 |
| 4,626,739 | 12/1986 | Shmulovich | 313/466 |
| 4,757,231 | 7/1988 | Kato et al. | 313/466 |

*Primary Examiner*—Sandra L. O'Shea
*Assistant Examiner*—Matthew J. Gerike
*Attorney, Agent, or Firm*—Norman N. Spain

[57] ABSTRACT

The brightness of a color CRT with a pigmented phosphor screen is improved by providing a composite layered screen in which a first layer of the composite layer is a relatively thin, heavily pigmented layer and a second is non-pigmented.

11 Claims, 2 Drawing Sheets

PHOSPHOR SEARCH INCLUDING A NON-PIGMENTED PHOSPHOR AND RGB PHOSPHOR ELEMENTS FOR A CRT

BACKGROUND OF THE INVENTION

This invention relates to a cathode ray tube (CRT) for color television and allied display applications, and more particularly relates to such a CRT having a pigmented phosphor screen, and to methods for producing it.

CRTs for color television, computer monitors and other display applications rely on a cathodoluminescent phosphor screen to provide a visible display. Such a screen is composed of a repetitive pattern of a large number of small red, blue and green-emitting phosphor elements, which are excited to luminescence by electron beams emanating from an electron gun behind the screen. There are three beams, one for each of the red, blue and green components of a color display signal. In operation, the screen is repetitively scanned by the three beams simultaneously, while the intensities of the beams are modulated by the respective individual primary color components of the display signal. The large number of phosphor elements, together with the scanning frequency, results in the perception of a steady, full color display by a viewer.

Such CRTs are designed to have sufficient brightness to operate in the presence of ambient light, even daylight. Various measures are taken to reduce the amount of ambient light which is reflected from the CRT back to the viewer, thus ensuring that the display has adequate contrast. For example, it is an almost universal practice of the CRT manufacturer to include as a part of the display screen a light-absorbing matrix in the spaces between the phosphor elements. Other common techniques are to incorporate a light absorbing material in the transparent display window, and to apply a low reflectivity coating or layer to the front of the display window.

Another factor which can reduce contrast of the display is the reflectivity of the phosphor particles themselves, particularly those having a light body color. It is known to reduce the reflectivity of such particles and to enhance the overall contrast of the display by coating the particles with smaller "pigment" particles having approximately the same color as the emission color of the phosphor. Unfortunately, such pigment particles reduce the brightness of the phosphor by blocking or scattering the light emitted from the phosphor particles to which they adhere. Thus, the amount of pigment used must be tempered by the desire to maintain adequate display brightness.

OBJECTS AND SUMMARY OF THE INVENTION

It is an object of the invention to improve the display contrast of a color CRT.

It is another object of the invention to improve the contrast while minimizing any reduction in the brightness of a color CRT.

It is another object of the invention to provide a color CRT including a pigmented phosphor screen having improved brightness.

According to the invention, a color CRT includes a display window, a phosphor screen on the inside surface of the display window, the screen comprised of particles of at least one cathodoluminescent phosphor, and a reflective layer on top of the phosphor screen, characterized in that the phosphor particles are present in a composite layered structure of a first layer of phosphor particles having pigment particles adhered to the surfaces of the phosphor particles (herein "pigmented" particles), and a second layer of phosphor particles with substantially no pigment particles (herein "non-pigmented" particles), the second layer positioned on top of the first layer.

In this arrangement, the first pigmented phosphor layer, which is closest to the viewer, serves to enhance the contrast of the display by the reduction in reflectivity of the phosphor particles caused by the presence of the pigment particles. In addition, the second non-pigmented layer contributes to increased brightness over screens having phosphors which are entirely pigmented, due in part to the fact that the light emitted by the second layer is not attenuated by the presence of pigment particles on the surfaces of the particles in that layer. Thus, substantially all of the light emitted by the second layer in the direction of the reflective layer will be reflected back into the phosphor layer. Some of this light will be indirectly attenuated by the first layer. However, the total amount of light attenuated will be less than that attenuated in a screen in which all of the particles are pigmented.

In accordance with a preferred embodiment of the invention, the screen is made up of three arrays of phosphor elements emitting red, blue and green light, respectively, with the arrays interleaved to form a repetitive pattern of triplets of the three colors. As is known, such screens are typically formed by a multi-step photolithographic process in which arrays of each of the three colors are formed separately from one another. For example, in a typical process using a negative-acting photoresist, a photosensitive layer is formed on the inner surface of the display window, and then exposed to light through an apertured mask. The exposed areas become insolubilized and the unexposed areas are then removed by developing, ie, rinsing with a solvent, eg, water. The areas remaining define the elements of the array for the first color. For the next color, a second photosensitive layer is formed on top of the first array, and then exposed through the same mask by the same light source, but from a different location, resulting in exposure of areas adjacent to the elements of the first array. Subsequent development leaves the elements of the second array in place. The third array is then formed in the same manner.

The phosphor particles may be introduced into the process in several different ways. Perhaps the most commonly used technique is to form a slurry of the particles in a liquid photoresist, and then use this slurry to form the photosensitive layer. Another technique is to form the photosensitive layer, allow it to partially dry to a tacky state, and then "dust" the layer, ie., contact the layer with a cloud of dry phosphor particles, some of which particles then adhere to the tacky surface. A variation of this dusting process is the so-called electrostatic process, in which the phosphor particles are given an electrical charge prior to dusting. If carried out in the manner described in U.S. patent application Ser. No. 08/580,408 (Attorney Docket No. PHA 60,098) filed Dec. 28, 1995, in the names of Stacklehaus and Gelincke, such electrostatic dusting results in a more uniform distribution of phosphor particles across the screen surface than conventional dusting.

During subsequent processes to complete the manufacture of the CRT, the screen is subjected to elevated temperatures sufficient to decompose the photosensitive compositions, leaving substantially only phosphor particles.

In accordance with the invention, in any of the above described processes, or any other known or unknown process for producing such phosphor screens, at least one of the three arrays comprises a composite structure of a first layer containing pigmented phosphor particles and a second layer on top of the first layer containing non-pigmented phosphor particles.

It is preferred to have the thickness of the first layer smaller than that of the second layer, in order to minimize as much as possible reductions in brightness of the display caused by the presence of the pigment particles.

BRIEF DESCRIPTION OF THE DRAWING

The invention will now be described in detail with reference to the drawings, in which.

DESCRIPTION OF THE PREFERRED EMBODIMENTS

Figure 1:
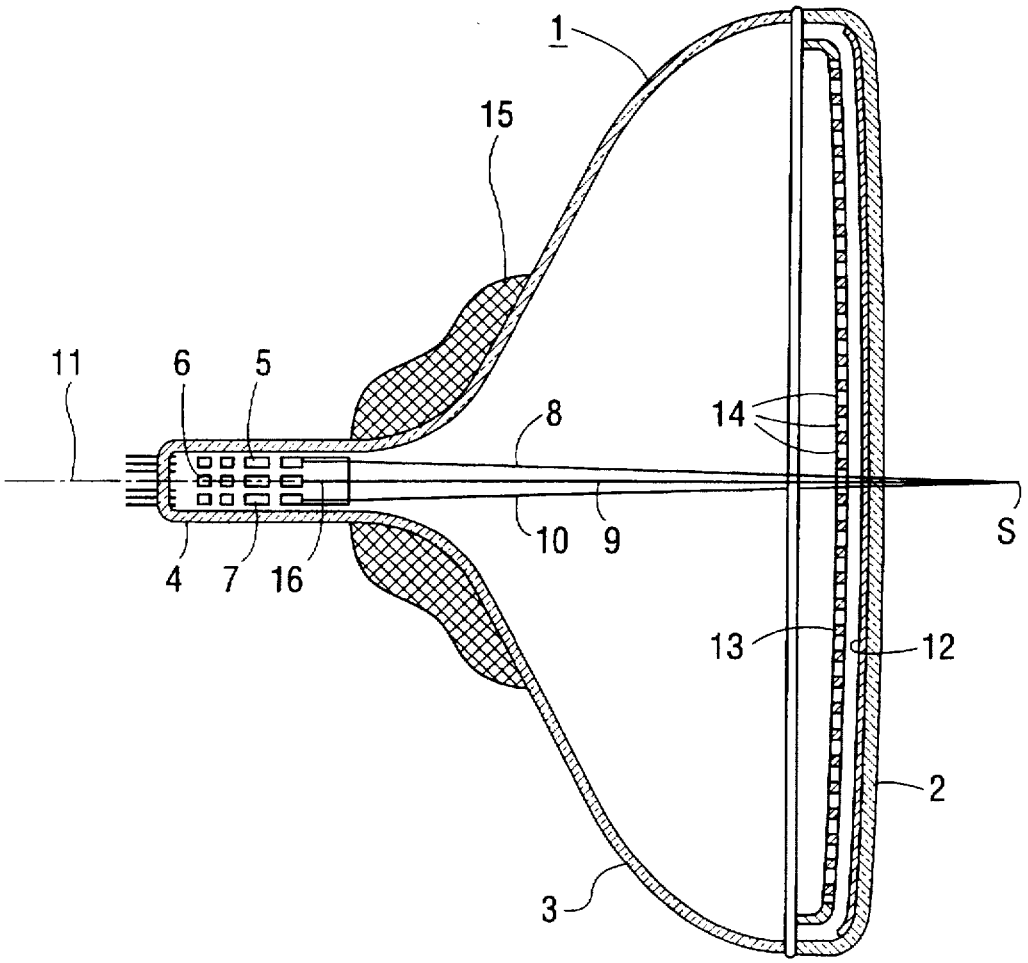
FIG. 1 is a diagrammatic sectional view of a known color CRT of the "in-line" type.

FIG. 1 is a diagrammatic sectional view of a known color cathode ray display tube of the "in-line" type. Three electron guns 5, 6 and 7, generating the electron beams 8, 9 and 10, respectively, are accommodated in the neck 4 of a glass envelope 1 which is composed of a display window 2, a funnel-shaped part 3 and a neck 4. The axes of the electron guns 5, 6 and 7 are situated in one plane, the plane of the drawing. The axis of the central electron gun 6 coincides substantially with the tube axis 11. The three electron guns are seated in a structure 16 which is situated coaxially in the neck 4. The display window 2 has on the inner surface thereof a large number of triplets of phosphor lines. Each triplet comprises a line of a phosphor luminescing green, a line of a phosphor luminescing blue, and a line of a phosphor luminescing red. All of the triplets together constitute a display screen 12. The phosphor lines are normal to the plane of the drawing. A shadow mask 12, in which a very large number of elongate apertures 14 are provided through which the electron beams 8, 9 and 10 pass, is arranged in front of the display screen 12. The electron beams 8, 9 and 10 are deflected in the horizontal direction (in the plane of the drawing) and in the vertical direction (at right angles thereto) by a system 15 of deflection coils. The three electron guns 5, 6 and 7 are assembled so that the axes thereof enclose a small angle with respect to each other. As a result of this, the generated electron beams 8, 9 and 10 pass through each of the apertures 14 at said angle, the so-called color selection angle, and each impinge only upon phosphor lines of one color.

Figure 2:
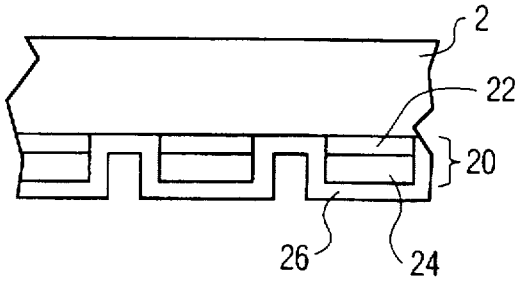
FIG. 2 is a cross section of a portion of the display portion of the CRT of FIG. 1, showing a composite phosphor screen of the invention.

In accordance with the teachings of the invention, each phosphor line is composed of a composite layer structure 20, shown in cross-section in FIG. 2, including a first layer 22 of a pigmented phosphor on the inside surface of display window 2, and a second non-pigmented layer 24 on the pigmented layer. A conventional vapor deposited reflective aluminum layer 26 on top of the layers 24 and covering the entire array of lines completes the screen structure.

The thickness of the composite layer 20 is dictated by the desire to achieve optimum brightness, and in general will be found to range between about 2.5 to 3 times the average particle size of the phosphor particles. See, for example, U.S. Pat. No. 3,697,301, issued Oct. 10, 1972, to Donofrio et al. Recent trends to larger size screens and larger operating voltages (30–35 inch diagonal and 30–35 kV, versus 20–25 kV for the conventional 13–27 inch sizes) may require thickness at the upper end of or even above this range, in order to absorb the more energetic electron beams.

Preferably, the first layer is relatively thin and heavily pigmented. Ideally, the first layer would constitute a monolayer of pigmented particles, having an average particle size of for example, 4 to 6 microns.

Figure 3:
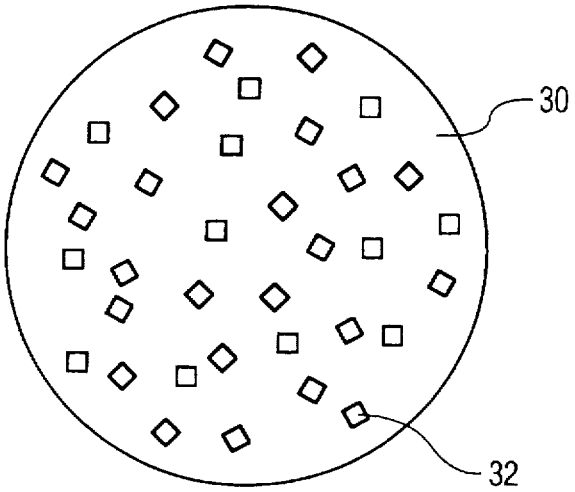
FIG. 3 is a diagrammatic representation of a pigmented phosphor particle of the screen of FIG. 2.

Preferably, the amount of pigment particles will range from about 3 to 6 times the amount used conventionally, for example, about 0.6 weight percent of the weight of the phosphor to be pigmented for the red phosphor, and about 5 weight percent for the blue. Typical pigment materials are $CoAl_2O_4$ for the blue phosphor material ZnS:Ag, and $Fe_2O_3$ for the red phosphor material $Y_2O_2S$:Eu. Generally, no pigment is used for the green, so that a high white brightness is achieved with unity current ratios. The particle sizes of the pigment particles are much smaller than the phosphor particles, as much as an order of magnitude or more. Typical particle sizes are about 90–700 nanometers for $CoAl_2O_4$ and 70–200 nanometers for $Fe_2O_3$. Typical binder materials for adhering the pigment particles to the surface of the phosphor particles are latex for slurry or silica or potassium silicate for dusting, in a particle size range of about 7–24 nanometers, generally in the amount of 0.03 weight percent of the total weight of phosphor plus latex, and 0.2 to 0.3 weight percent of the total weight of phosphor plus silica. A representative pigmented phosphor particle 30 with pigment particles 32 adhering to its surface is shown diagrammatically in FIG. 3.

The thickness of the pigmented layer will in general range from about 15 to 35 percent of the thickness of the composite layer. By way of example, for a monolayer of pigmented phosphor having an average particle size of about 4 microns, and a layer of about 14 microns in thickness of non-pigmented phosphor having an average particle size of about 8 microns, the thickness of the pigmented layer will be about 22 percent of the total thickness of 18 microns.

In practice, the first relatively thin, relatively heavily pigmented layer, which is, by virtue of being placed on the inside surface of the display window, the layer proximate to the viewer, will act as a conventional pigmented phosphor screen to reduce the reflectivity of the screen, and thereby reduce the reflection of ambient light by the screen. The particles of the second relatively thick non-pigmented layer will emit light without attenuation due to pigment particles, and thus will contribute a greater amount of light to the display. Brightness increases of from 5 to 15 percent over conventionally pigmented screens are expected, and consequently increases in display contrast of about 3–10 percent are also expected.

The invention has been described in terms of a limited number of embodiments. Other embodiments and variations of embodiments will become apparent to those skilled in the art, and are intended to be encompassed within the scope of the appended claims. For example, while the invention has been described in terms of a CRT with a funnel-shaped envelope, it will be appreciated that the advantages of the invention are obtainable in color CRTs of other configurations as well, such as flat panel CRTs.

What is claimed as the invention is:

1. A color CRT including a display window, a phosphor screen on the inside surface of the display window, the screen comprised of particles of at least one cathode luminescent phosphor, and a reflective layer on top of the phosphor screen, characterized in that the phosphor particles are present in a composite layered structure of a first layer of phosphor particles disposed on said inside surface and having pigment particles adhered to the surfaces of the phosphor particles, and a second layer of said phosphor particles with substantially no pigment particles, the second layer positioned on top of the first layer.

2. The color CRT of claim 1 in which the screen is made up of first, second and third arrays of phosphor elements emitting red, blue and green light, respectively, with the arrays interleaved to form a repetitive pattern of triplets of the three colors, and in which at least one of the arrays comprises the composite layered structure.

3. A color CRT of the type claimed in claim 2, wherein a method of producing a CRT comprises forming the arrays of each of the three colors separately from one another by a multi-step photolithographic process.

4. A color CRT as claimed in claim 3 in a method of producing a CRT in which for each color a negative-acting photoresist is formed on the inner surface of the display window, and then exposed to light through an apertured mask, as a result of which the exposed areas become insolubilized, after which the unexposed areas are removed by rinsing with a solvent, wherein the photosensitive layers for the second and third arrays are formed on top of the first array, and then exposed through the same mask by the same light source, but from a different location, resulting in exposure of areas adjacent to the elements of the first array.

5. A color CRT as claimed in claim 4 in which the photoresist layers are formed from a slurry of phosphor particles in a liquid photoresist.

6. A color CRT as claimed in claim 4 in a method of producing a CRT in which prior to exposure of the photoresist layers, the photosensitive layers are allowed to partially dry to a tacky state, and the layers are then contacted with a cloud of dry phosphor particles, some of which particles then adhere to the tacky surface.

7. A color CRT as claimed in claim 6 in a method of producing a CRT in which the dry phosphor particles are given an electrical charge prior to contacting to tacky photoresist layers.

8. The method of claim 4 the screen is subjected to elevated temperatures sufficient to decompose the photosensitive compositions, leaving substantially only phosphor particles.

9. The color CRT of claim 2 in which the first and second arrays comprise the composite layered structure.

10. The color CRT of claim 1 in which the thickness of the first layer is smaller than the thickness of the second layer.

11. The color CRT of claim 10 in which the thickness of the first layer is from about 20 to 35 percent of the thickness of the composite layer.

* * * * *